United States Patent [19]

Nohira et al.

[11] 4,117,046

[45] Sep. 26, 1978

[54] VARIABLE-VENTURI CARBURETOR

[75] Inventors: Hidetaka Nohira, Mishima; Masaaki Tanaca, Susono, both of Japan

[73] Assignee: Toyota Jidosha Kogyo Kabushiki Kaisha, Japan

[21] Appl. No.: 846,460

[22] Filed: Oct. 28, 1977

[30] Foreign Application Priority Data

Jul. 7, 1977 [JP] Japan ..... 52/80399

[51] Int. Cl.[2] ..... F02M 9/06

[52] U.S. Cl. ..... 261/44 C

[58] Field of Search ..... 261/44 C, 50 A

[56] References Cited

U.S. PATENT DOCUMENTS

| | | | |
|---|---|---|---|
| 3,243,167 | 3/1966 | Winkler | 261/44 C |
| 3,281,131 | 10/1966 | Mennesson | 261/50 A |
| 3,284,063 | 11/1966 | Bickhaus et al. | 261/50 A |
| 3,285,585 | 11/1966 | Mennesson | 261/50 A |
| 3,322,408 | 5/1967 | Stoltman | 261/50 A |
| 3,493,217 | 2/1970 | Farley | 261/44 C |
| 4,000,226 | 12/1976 | Laprade et al. | 261/50 A |

FOREIGN PATENT DOCUMENTS

| | | | |
|---|---|---|---|
| 2,043,669 | 3/1972 | Fed. Rep. of Germany | 261/44 C |
| 718,381 | 11/1954 | United Kingdom | 261/50 A |
| 1,227,358 | 4/1971 | United Kingdom | 261/44 C |

*Primary Examiner*—Tim R. Miles

[57] ABSTRACT

This application discloses a variable-venturi carburetor of an internal combustion engine. The carburetor comprises: a variable venturi; a pressure source for actuating the venturi; a working chamber into which the pressure is introduced from the pressure source so as to actuate the venturi; a pipe which connects the pressure source and the working chamber; and a diaphragm type pressure control valve, the inlet of the valve being communicated with the atmosphere, the outlet of the valve being connected to the pipe, the diaphragm chamber of the valve being communicated with the intake pipe of the engine at a portion between the throttle valve and the venturi.

5 Claims, 5 Drawing Figures

VARIABLE-VENTURI CARBURETOR

BACKGROUND OF THE INVENTION

The present invention relates to a variable-venturi carburetor of an internal combustion engine wherein the sectional area of the venturi is variable so as to maintain the intake air velocity constant at a fuel port in spite of the change of the intake air quantity.

In a known variable-venturi carburetor, e.g. in an SU (Skinner Union) type carburetor, a movable element of the venturi comprises a piston which slides toward the inside of the intake pipe so as to vary the sectional area of the air passage. The piston is actuated by the vacuum derived from the intake pipe at a portion between the throttle valve and the venturi. The negative pressure at that portion is relatively weak. Accordingly, turbulences of the air flow affect the movement of the piston unexpectedly in an undesired manner, therefore, an oil damper is used in an actual SU type carburetor so as to reduce this unstable condition. Besides, the piston does not slide smoothly because the resistance of the piston to the sliding movement is relatively strong as compared with the resistance of the piston to a restoring spring, the force of which spring is relatively weak corresponding to the intake vacuum pressure at the portion and the hysteresis of the movement of the venturi is a problem under actual SU type carburetor. If the intake vacuum pressure is increased, the speed of the intake air passing through the venturi increases, causing difficulty in the precise control of the air/fuel ratio. The vacuum pressure acting upon the piston is greater when the venturi sectional area is large, than in the case when the venturi sectional area is small, due to the increase of the compressive force of the restoring spring. Accordingly, the vacuum pressure at the portion between the throttle valve and the venturi is not maintained constant, hence the air velocity varies. Especially when the throttle valve opening is small and the resulting vacuum pressure at the portion is small, fuel is not adequately atomized because the air velocity is too slow.

SUMMARY OF THE INVENTION

An object of the invention is to obviate the above-mentioned drawbacks. In a variable-venturi carburetor according to the invention, a movable element of the venturi slides smoothly, and the intake air speed at the venturi is maintained constant by maintaining the intake vacuum pressure in the intake pipe at the portion between the throttle valve and the venturi so that the fuel is desirably atomized. The variable-venturi carburetor according to the invention comprises: a variable venturi; a pressure source for actuating the venturi; a working chamber into which the pressure is introduced from the pressure source so as to actuate the venturi; a pipe which connects the pressure source and the working chamber; and a diaphragm type pressure control valve, the inlet of the valve being communicated with the atmosphere, the outlet of the valve being connected to the pipe, the diaphragm chamber of the valve being communicated with the intake pipe of the engine at a portion between the throttle valve and the venturi.

DETAILED DESCRIPTION OF THE PREFERRED EMBODIMENTS OF THE INVENTION

The present invention will now be described with reference to the appended drawings in which FIGS. 1 through 4 illustrate four individual embodiments, respectively, and FIG. 5 graphically illustrates the changing curve of the pressure difference between atmosphere and the portion below the venturi at the portion between the throttle valve and the venturi with respect to the intake air quantity.

Figure 1:
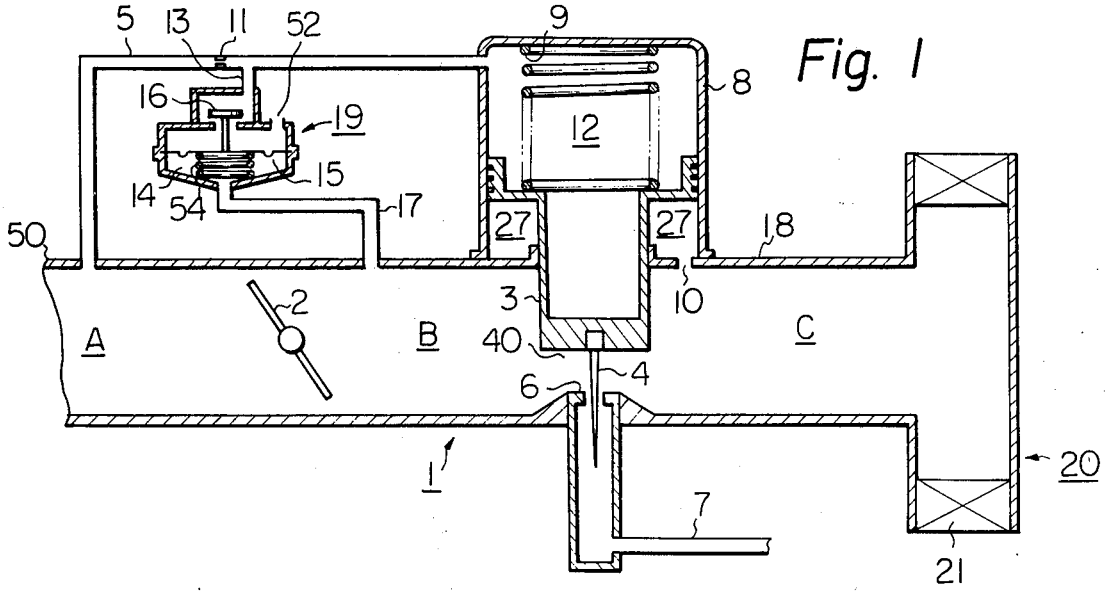

In a variable-venturi carburetor 1 illustrated in FIG. 1, a variable venturi 40 is defined by a lower end of a piston 3 and a portion around a fuel injection nozzle 6. A jet needle 4 is mounted on the lower end of the piston 3. The fuel is supplied through a fuel pipe 7. The air is introduced through an air cleaner 20 which comprises an air filter 21. The piston 3 is slidable along the inside wall of a cylinder 8. A working chamber, which in this particular case is a vacuum chamber 12, is formed above the piston 3 within the cylinder 8. A pressure chamber 27 is formed outside the intake pipe 18, outside the piston 3 and within the cylinder 8. The pressure chamber 27 communicates with the inside of the intake pipe at a portion upstream of the venturi 40, through a hole 10, which portion is indicated by the reference letter C. Accordingly, the pressure chamber 27 is always acted upon by the atmospheric pressure. A restoring spring 9 is arranged within the cylinder 8. The inside portion A of the intake manifold 50 communicates with the vacuum chamber 12 through a vacuum pipe 5. Accordingly, in this embodiment, the intake manifold 50 is the pressure source for actuating the venturi. An outlet 13 of a diaphragm type pressure control valve 19 is connected to the vacuum pipe 5. An inlet 52 of the valve 19 communicates with the atmosphere. A diaphragm chamber 14 of the valve 19 communicates with an inside portion B of the intake pipe 18 between a throttle valve 2 and the venturi 40. An orifice 11 is arranged within the vacuum pipe 5.

The variable-venturi carburetor according to the invention operates as follows. When the throttle valve opening is increased during when the engine is operating, the vacuum pressure at the portion B is increased because the high vacuum pressure at the portion A is introduced into the portion B through the wide-open throttle valve 2. Accordingly, the vacuum pressure within the diaphragm chamber 14 of the pressure control valve 19 is increased so that a diaphragm 15 is moved downward against the force of a spring 54. Thus, a valve 16 of the control valve 19 is closed. Therefore, the atmospheric pressure is not introduced into the vacuum pipe 5. Accordingly, the high intake vacuum at the portion A is introduced into the vacuum chamber 12 through the vacuum pipe 5 so that the piston 3 is moved upward against the fource of the spring 9. Consequently, the passage area of the venturi 40 is increased so that the intake air is increased. At the same time, the gap between the nozzle 6 and the jet needle 4 is increased so that the fuel injection quantity is increased. According to the increase of the intake air, the vacuum pressure at the portion B is lowered so that the valve 16 of the pressure control valve 19 is moved upward by the force of the spring 54. Thus, the atmospheric pressure is introduced into the vacuum pipe 5, resulting in that the pressure in the vacuum chamber 12 is increased so that the piston 3 is depressed downward. Accordingly, the passage area of the venturi 40 is decreased. The above-described operation is repeated so that the vacuum pressure at the portion B is maintained approximately constant. A desired constant vacuum pressure at the portion B is attained by adjusting the force of the spring 54 of the pressure control valve 19. When the throttle valve 2 is opened wide, the vacuum pressure at the portion B is highly increased, which condition requires much time to restore the high vacuum level to a constant value. Therefore, the piston 3 is greatly moved upward so that the passage area of the venturi 40 is widened. On the other hand, when the throttle valve opening is small, the vacuum pressure at the portion B is relatively low, which condition requires less time to restore the low vacuum level to a constant value. Therefore, the amount of upward movement of the piston 3 is relatively small which in turn causes the passage area of the venturi 40 to be small.

In the above-mentioned variable-venturi carburetor, the high vacuum pressure in the intake manifold actuates the piston 3 so that the affect produced on the sliding movement of the piston 3 by the turbulence of the air flow or sliding resistance to the piston 3 is relatively small. Accordingly, the piston 3 can slide smoothly. The pressure change at the portion B is about 5 $mmH_2O$, which change is substantially equal to the change of load applied to the spring 54 of the pressure control valve 19. In the prior art, the pressure change at the portion B is about 40 $mmH_2O$, which is substantially equal to the change of load applied to the restoring spring of the piston 3.

Figure 5:
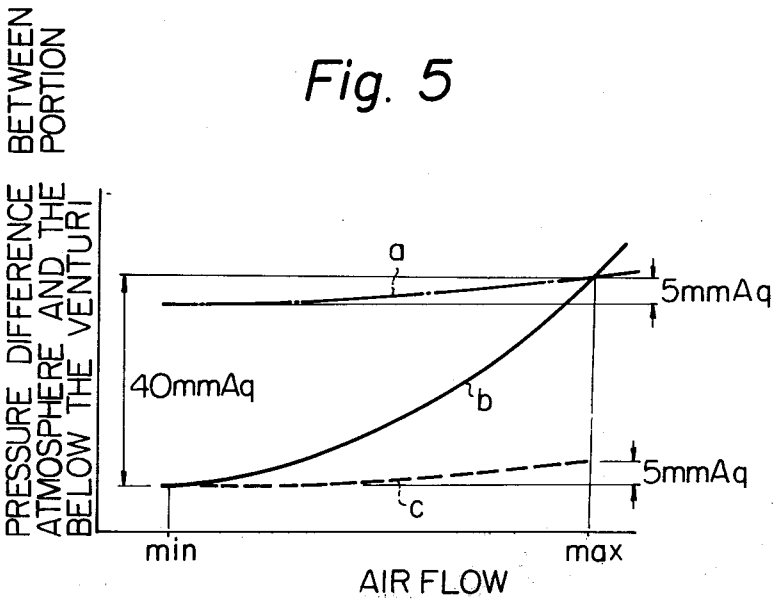

In FIG. 5, the pressure change at the portion B is graphically shown with respect to the intake air quantity. A dash-dot line "*a*" and a dotted line "*c*" in FIG. 5 show respective cases according to the invention, while a solid line "*b*" shows the case of the prior art. In the case of curve "*c*", the aforementioned desired constant vacuum at the portion B is different from that shown by the curve "*a*" due to the adjustment of the spring 54 of the pressure control valve 19. In the variable-venturi carburetor according to the invention, the pressure change at the portion B is much smaller than that of the prior art so that the air flow speed at the venturi 40 is maintained approximately constant regardless of the degree of the throttle valve opening, which results in the satisfactory atomization of the fuel.

Figure 2:
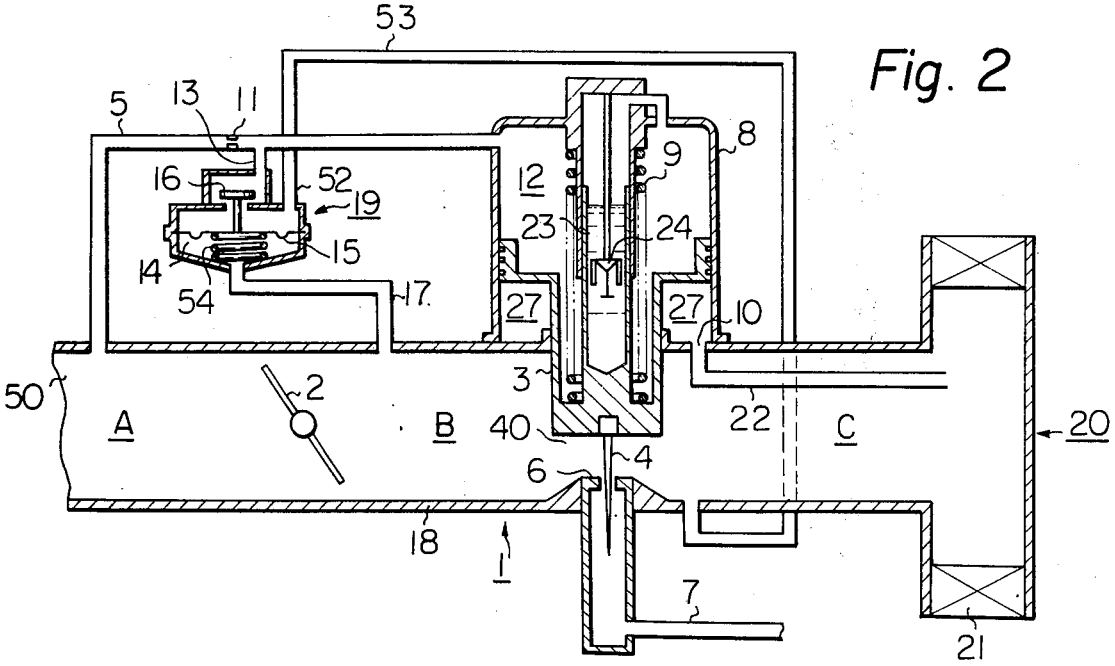

In another embodiment shown in FIG. 2, an oil damper 24 is arranged in the cylinder 8 in order to prevent the occurrence of a sudden movement of the piston 3. Oil is indicated by the reference numeral 23. The pressure chamber 27 communicates with the inside of the air cleaner 20 through a pipe 22. The inlet 52 of the pressure control valve 19 communicates with the portion C of the intake pipe 18, which portion being upstream of the venturi 40. The second embodiment illustrated in FIG. 2 operates in substantially the same manner as the first embodiment illustrated in FIG. 1.

Figure 3:
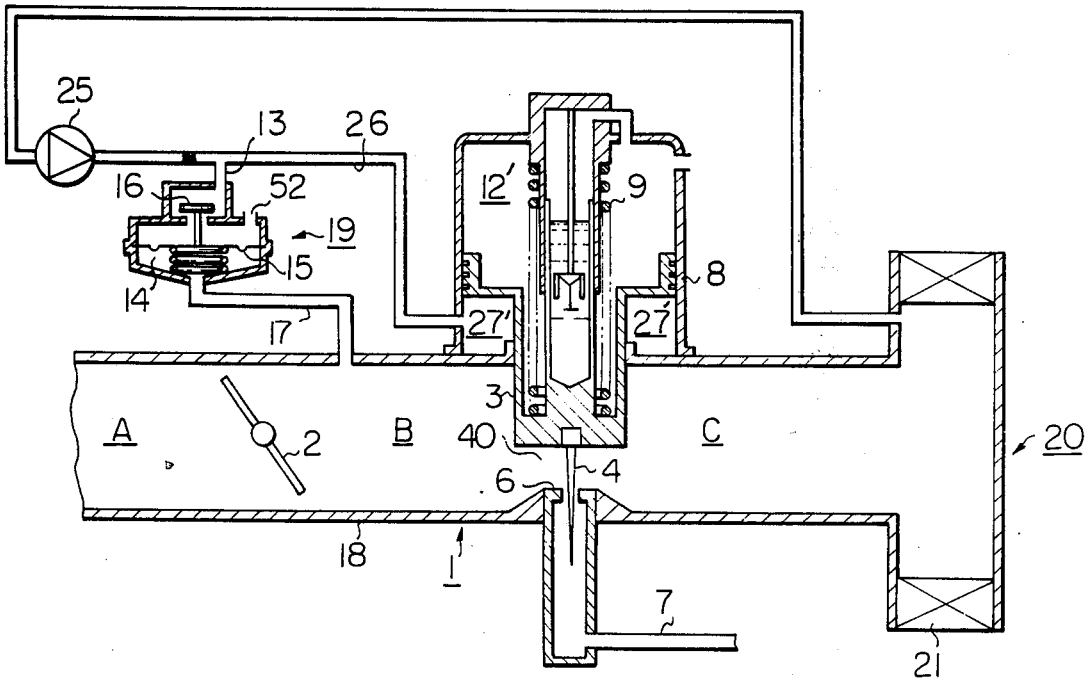

In FIG. 3, another embodiment is illustrated. In this case, an air pump 25 is provided as a pressure source. Compressed air is supplied to the pressure chamber 27' through a pipe 26. The pressure chamber 27', in this embodiment, serves as a working chamber which actuates the piston 3 so as to slide along the cylinder 8. The space 12' located above the piston 3 and within the cylinder 8 communicates with the atmosphere.

During operation, when the throttle valve 2 is opened wide, the vacuum pressure at the portion B is increased so that the valve 16 of the pressure control valve 19 is closed in the same manner as that of the first embodiment. Therefore, the compressed air is supplied from the air pump 25 to the pressure chamber 27' through the pipe 26 so as to move the piston upward. Thus, the passage area of the venturi 40 is increased. When the throttle valve opening is decreased, the vacuum pressure at the portion B is decreased so that the valve 16 of the pressure control valve 19 is opened in the same manner as that of the first embodiment. Therefore, the compressed air escapes to the atmosphere through the pressure control valve 19 so that the pressure in the pressure chamber 27' is lowered thus causing the piston 3 to be depressed downward by the spring 9. Thus, the passage area of the venturi 40 is decreased. Except for the above-mentioned operation, the third embodiment operates in substantially the same manner as that of the first embodiment.

Figure 4:
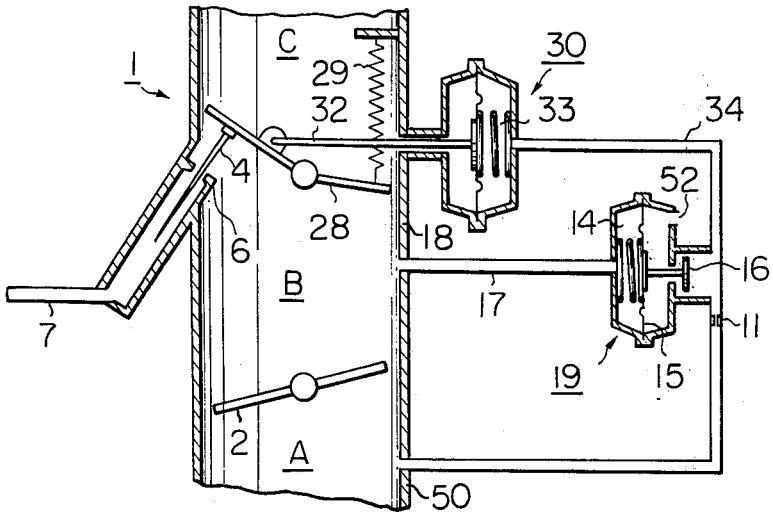

In the fourth embodiment illustrated in FIG. 4, the variable venturi comprises an intake air passage adjuster valve (or air valve) 28. The valve 28 is actuated by a diaphragm device 30 through a rod 32. Reference numeral 29 indicates a restoring spring. A diaphragm chamber 33 of the diaphragm device 30 communicates with the portion A, which is located downstream of the throttle valve 2 through a vacuum pipe 34. The pressure control valve 19 is arranged on the vacuum pipe 34 in substantially the same manner as that in the aforementioned embodiments.

When the throttle valve opening is increased, the pressure control valve 19 operates so that the intake vacuum is introduced into the diaphragm chamber 33. Therefore, the rod 32 is pulled right-ward so that the gap between the intake pipe 18 and the valve 28 is increased. When the throttle valve opening is decreased, the pressure control valve 19 operates so that the atmospheric pressure is introduced into the diaphragm chamber 33. Therefore, the rod 32 is moved leftward so that the gap between the intake pipe 18 and the valve 28 is decreased. Except for the above operation, the function of the fourth embodiment is substantially the same as that of the first embodiment. In the fourth embodiment, the shape of the valve 28 is not restricted to that illustrated in FIG. 4.

The present invention is not limited to the above-mentioned embodiments, but can be modified within the scope of the appended claim.

What is claimed is:

1. A carburetor of an internal combustion engine comprising:

a means for varying the sectional area of the intake air passage of the engine;

a pressure source for actuating said varying means;

a working chamber into which pressure is introduced from said pressure source so as to actuate said varying means;

a pipe which connects said pressure source and said working chamber, and;

a diaphragm type pressure control valve, the inlet of said valve being communicated with the atmosphere, the outlet of said valve being connected to said pipe, and the diaphragm chamber of said valve being communicated with the intake pipe of the engine at a portion between the throttle valve and said varying means.

2. A carburetor according to claim 1, wherein said varying means comprises a variable venturi.

3. A carburetor according to claim 1, wherein said varying means comprises a variable air valve.

4. A carburetor according to claim 1, wherein said pressure source is an intake manifold, for supplying the intake vacuum to said working chamber.

5. A carburetor according to claim 1, wherein said pressure source is an air pump for supplying compressed air to said working chamber.

* * * * *